United States Patent [19]

Little

[11] Patent Number: 4,647,047

[45] Date of Patent: Mar. 3, 1987

[54] PRACTICE PUTTING CUP

[76] Inventor: Carl W. Little, 1915 W. Division St., Chicago, Ill. 60622

[21] Appl. No.: 812,958

[22] Filed: Dec. 24, 1985

[51] Int. Cl.[4] ..... A63B 69/36

[52] U.S. Cl. ..... 273/178 A; 273/177 A

[58] Field of Search ..... 273/178 A, 178 R, 177 R, 273/177 A, 177 B, 179 R, 179 A, 179 B, 179 C, 179 D, 179 E, 180

[56] References Cited

U.S. PATENT DOCUMENTS 1,823,487 9/1931 Clear ..... 273/178 A 2,836,422 5/1958 Borah ..... 273/178 A

*Primary Examiner*—George J. Marlo

*Attorney, Agent, or Firm*—Kenneth J. Pedersen

[57] ABSTRACT

A new putting cup comprising a circular base and concentric conoidal wall portion is described. In the cup there is a set of discrete junctions of the base and wall portion which provides a hinge for the wall portion to fold down under a golf ball and over the top base surface radially inward from its junction with the wall portion so that resistance of the putting cup to the approaching golf ball is minimized. The hinge for the wall portion is provided by the discrete junction of the outside wall surface with the top base surface being further in perpendicular distance from the bottom base surface than is the discrete junction of the inside wall surface with the top base surface.

3 Claims, 3 Drawing Figures

PRACTICE PUTTING CUP

BACKGROUND OF THE INVENTION

1. Field of the Invention

This invention relates to the game of golf, and to a device for simulating a golf hole or cup, useful for practicing putting or for playing indoor or miniature golf.

2. Description of the Prior Art

U.S. Pat. No. 1,135,706 discloses a putting cup comprising an annular base ring with a truncated cone wall portion.

U.S. Pat. No. 1,823,487 discloses a putting cup wherein the base portion tapers in thickness from an interior point outwardly to a continuously smooth junction with the flexible wall portion.

U.S. Pat. No. 2,836,422 discloses a putting cup wherein the flexible wall portion has alternating thinner and thicker sections, the thicker sections serving as reinforcement ribs for increased wall strength for the thinner, more flexible sections.

The prior art has attempted to provide a putting cup which accurately simulates a golf hole or cup. In golf, the best approach of the ball to the hole is to have the ball "die" near the hole if it does not actually drop in it. Therefore, the ball should be traveling very slowly near the hole, and when a putting cup is being used to simulate the hole, the ball should not be made to overcome much resistance to roll into the cup.

Attempts have been made to minimize resistance to the approaching golf ball at the peripheral edge of the putting cup base, at the junction of the base and the wall, and in the wall itself so that a ball which is properly stroked will roll into the cup. Also, attempts have been made to adjust the cup wall characteristics so that a ball which is properly stroked will be retained by the cup, while a ball which is improperly directed will be deflected by it, and a ball stroked with too much force will pass through the cup and escape.

SUMMARY OF THE INVENTION

This invention relates to a putting cup which comprises in combination:

(i) a base portion of disc form, with top and bottom surfaces; and (ii) a flexible wall portion of conoidal form, with outside and inside surfaces; said flexible wall portion extending upwardly and inwardly from the top surface of said base portion from discrete junctions, radially inward from the periphery of said base portion, of the outside and inside wall surfaces, respectively, with the top surface of said base portion, wherein the discrete junction of the outside wall surface with the top base surface is further from the bottom base surface than is the discrete junction of the inside wall surface with the top base surface.

The particular design of my putting cup at the junction of the base and flexible wall portions provides an effective hinge for the wall portion at the contact point where the golf ball rolls against the wall. Thus, with my design only slight resistance will be encountered by the ball at the wall, and depression of the wall portion by it will be relatively quick and easy, accurately simulating the interaction of the golf ball and a golf hole or cup.

DESCRIPTION OF THE PREFERRED EMBODIMENTS

Figure 1:
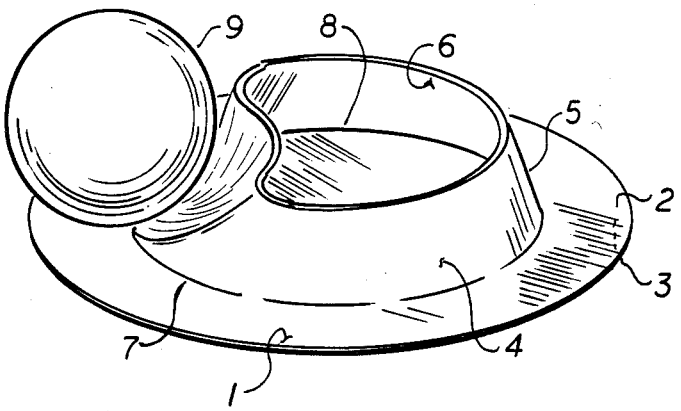
FIG. 1 is a perspective view of a device embodying the invention, with a ball shown entering it.

Referring now to the accompanying Drawings:

FIG. 1 depicts: circular disc base portion (1) with top base surface (2) and bottom base surface (3); concentric conoidal wall portion (4); with outside wall surface (5) and inside wall surface (6); and a discrete junction (7) of the outside wall surface with the top base surface and a discrete junction (8) of the inside wall surface with the top base surface. By a discrete junction I mean a particular point of intersection, contrasted with, for example, a continuously smooth junction like the one disclosed in U.S. Pat. No. 1,823,487. For my putting cup discrete junctions (7) and (8) provide the pivot points for the hinge between the base portion and the flexible wall portion. In this Drawing these discrete junctions appear as lines between the respective top base and wall surfaces. FIG. 1 also depicts a golf ball (9) entering the cup by rolling over the top base surface and depressing the outside wall surface which folds down over the inside wall surface and the top base surface radially inward from its junctions with the wall portion.

My putting cup is preferably composed of rubber or some other similar plastic composition which will yield or bend radially inward when a golf ball impacts against the wall portion of it so that the ball can roll freely into the cup. Yet, the composition must offer more resistance to the ball from escaping the cup, but not an absolute resistance, so that if the ball is stroked too hard, it will roll into the cup, but also through it and out again on the opposite side. What material has worked best for me has been silicon rubber compositions with Durometer test readings of between about 35 and 50.

My cup is designed to accurately simulate an official golf hole or cup. Therefore, it is preferably about 4 or $4\frac{1}{4}$ inches in diameter at the top of the wall portion. For my best models, the vertical height of the wall portion has been about $\frac{3}{4}$ inches, with the average thickness of the wall portion being about 125/1000 inches, it being about 200/1000 inches thick at the bottom where it joins with the base portion, and tapering gradually to about 20/1000 inches thick at the top. Preferably, the diameter of the base portion is about 8 inches. However, my invention is not to be restricted to these or to any other specific dimensions.

I think the best way to make my putting cup is to form it in a suitably constructed mold from a hot melt precursor of the final rubber or plastic compostion.

The best way to use my putting cup is to toss it on the floor or ground, bottom base surface down, several feet away from the person doing the putting. Then the person can stroke the golf ball at the cup with any golf putter or golf club.

Figure 2:
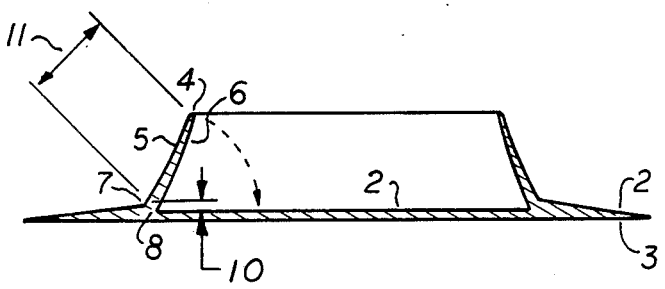
FIG. 2 is a view of a central vertical section of a device embodying the invention, showing details of the ball contact area.

FIG. 2 depicts a view of a central vertical section of one embodiment of my putting cup with all the features depicted in FIG. 1, except for the golf ball (9). In this Drawing the discrete junctions (7) and (8) appear as points of intersection of the top base and respective outside and inside wall surfaces.

From the Drawing it is clear that discrete junction (7) of the outside wall surface with the top base surface is further, in a perpendicular direction, from the bottom base surface (3) than is discrete junction (8) of the inside wall surface with the top base surface. The vertical difference in this perpendicular distance is depicted as item (10) in the Drawing. Preferably the distance (10) is equal to or greater than the average thickness of the flexible wall portion (4). This allows the wall portion, when it is depressed by the ball, to lay down beneath the ball without creating a bump at its junctions with the respective top base surfaces. Preferably, the discrete junction (7) of the outside wall surface with the top base surface is further from the bottom base surface (3) than is the top base surface (2) radially inward from the discrete junction (8) of the inside wall surface with the top base surface for a distance of at least the vertical length of the inside wall surface. The vertical length of the inside wall surface is depicted as item (11) in the Drawing. This allows the wall portion, when it is depressed by the ball, to lay down beneath it without creating an uphill slope for the ball to roll over for the length of the wall portion.

Figure 3:
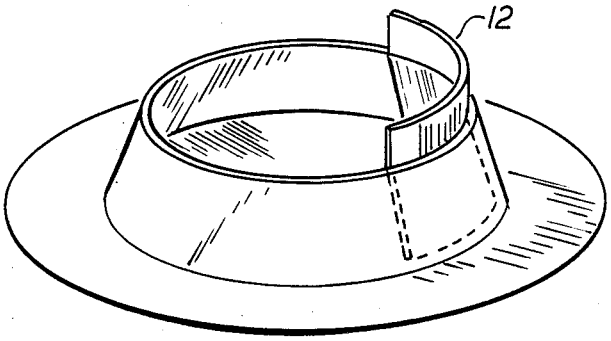
FIG. 3 is a view similar to FIG. 1, but showing also a tab insert member placed in the back of the cup to prevent the ball from escaping it.

FIG. 3 depicts the putting cup of FIG. 1, plus a generally rectangular, flexible tab member (12) placed perpendicularly with respect to the top base surface radially inward from its junctions with the wall surfaces so as to contact and conform substantially with part of the inside wall surface. The tab member (12), which can be made of thin, flexible plastic, or even stiff paper or cardboard, should be long enough to contact from about $\frac{1}{4}$ to about $\frac{1}{2}$ the perimeter of the cup, and high enough to impart to the wall portion which it contacts and conforms to enough stiffness to prevent the rolling ball in the cup from depressing the wall portion in a radially outward direction. The tab member (12) is placed in the back of the cup, opposite from the incoming ball direction, to help prevent the ball from escaping the cup.

What I claim is:

1. A putting cup which comprises in combination:

(i) a base portion (1) of disc form, with top surface (2) and bottom surface (3); and (ii) a flexible wall portion (4) of conoidal form, with outside surface (5) and inside surface (6); said flexible wall portion (4) extending upwardly and inwardly from the top surface (2) of said base portion (1) from discrete junctions (7) and (8), radially inward from the periphery of said base portion (1), of the outside wall surface (5) and inside wall surface (6), respectively, with the top surface (2) of said base portion (1), wherein the discrete junction (7) of the outside wall surface (5) with the top base surface (2) is further in perpendicular distance (10) from the bottom base surface (3) than is the discrete junction (8) of the inside wall surface (6) with the top base surface (2).

2. The putting cup of claim 1 wherein the discrete junction (7) of the outside wall surface (5) with the top base surface (2) is further in perpendicular distance (10) from the bottom base surface (3) than is the top base surface (2) radially inward from the discrete junction (8) of the inside wall surface (6) with the top base surface (2) for a distance (11) of at least the vertical length of the inside wall surface (6).

3. The putting cup of claim 1 which also comprises a generally rectangular, flexible tab member (12) placed perpendicularly with respect to the top base surface (2) radially inward from its discrete junctions (7) and (8) with the wall surfaces (5) and (6), respectively, so as to contact and conform substantially with part of the inside wall surface (6), and impart to the wall portion which it contacts and conforms to enough stiffness to prevent the rolling ball in the cup from depressing the wall portion in a radially outward direction.

* * * * *